US010188922B1

(12) United States Patent
Bahash

(10) Patent No.: US 10,188,922 B1
(45) Date of Patent: Jan. 29, 2019

(54) PUTTING SKILL GAME

(71) Applicant: Nicholas A Bahash, Rogers, AR (US)

(72) Inventor: Nicholas A Bahash, Rogers, AR (US)

( * ) Notice: Subject to any disclaimer, the term of this patent is extended or adjusted under 35 U.S.C. 154(b) by 0 days.

(21) Appl. No.: 15/190,107

(22) Filed: Jun. 22, 2016

Related U.S. Application Data

(60) Provisional application No. 62/196,156, filed on Jul. 23, 2015.

(51) Int. Cl.
*A63B 67/02* (2006.01)
*A63B 63/00* (2006.01)

(52) U.S. Cl.
CPC ..... *A63B 67/02* (2013.01); *A63B 2063/001* (2013.01); *A63B 2210/50* (2013.01)

(58) Field of Classification Search
CPC ..... A63B 67/02
See application file for complete search history.

(56) References Cited

U.S. PATENT DOCUMENTS 1,262,314 A * 4/1918 Downey ..... A63F 7/0005 273/352
3,831,949 A * 8/1974 Henning ..... A63B 67/02 473/158
5,529,304 A * 6/1996 Wood ..... A63B 67/02 473/163
6,849,000 B2 * 2/2005 Chen ..... A63B 67/02 473/153
7,563,171 B2 * 7/2009 Barz ..... A63B 24/0021 473/163

* cited by examiner

*Primary Examiner* — Michael Dennis
(74) *Attorney, Agent, or Firm* — Schrantz Law Firm, PLLC; Stephen D. Schrantz

(57) ABSTRACT

The putting game device provides a rigid putting surface with an attached green that leads to a ramp. The ramp and putting surface store within a housing to create a mobile game that is easily stored and transported. The housing includes a support to angle the housing and the game board for play. Each game board provides at least one cup, preferably multiple cups, for the user to putt the ball into. The targets may be simple holes in the game board or the targets may be a raised target that extends vertically above the game board. The game device also enables the installation of different game boards for different target arrangements.

4 Claims, 12 Drawing Sheets

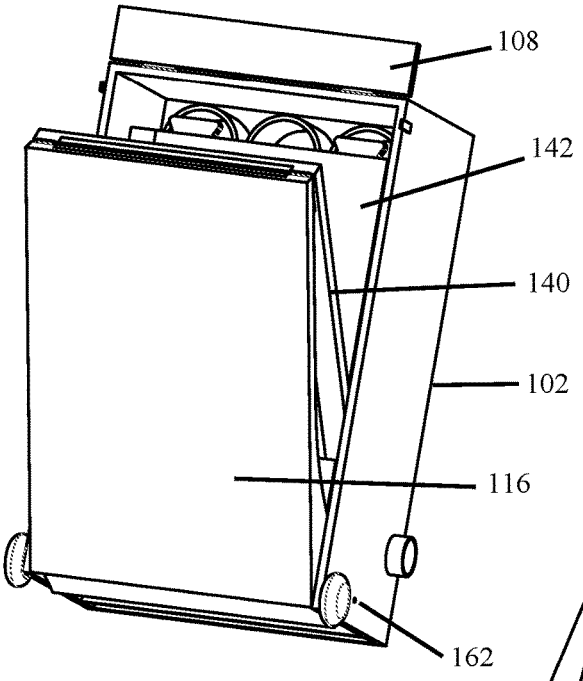
FIG. 7
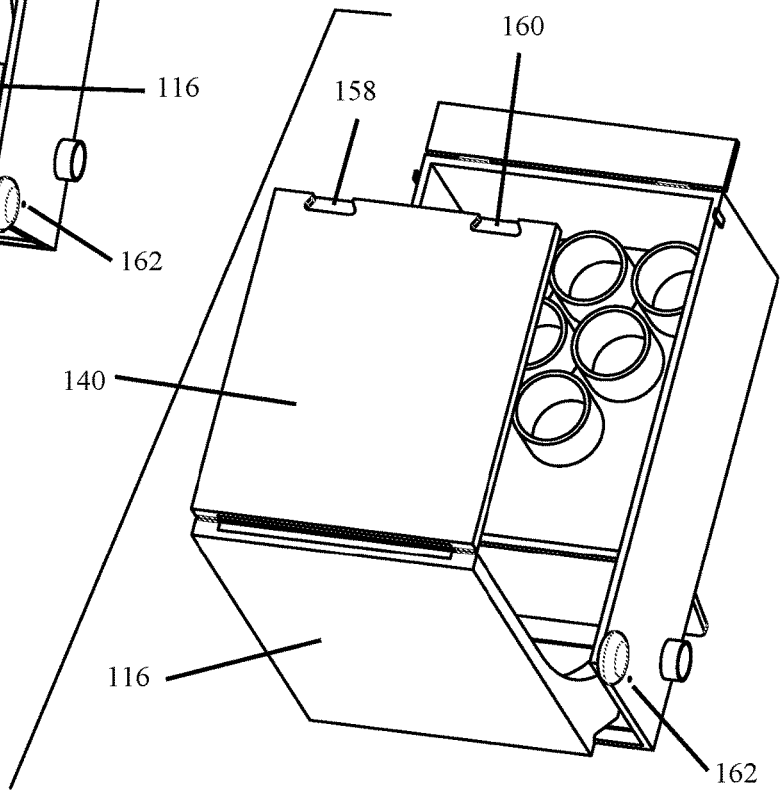
FIG. 8
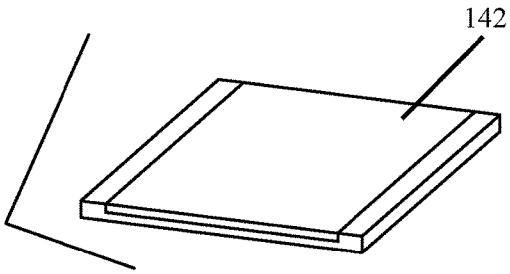

PUTTING SKILL GAME

CROSS-REFERENCE TO RELATED APPLICATIONS

This application claims priority to and is a continuation in part of U.S. Patent Application No. 62/196,156 filed on Jul. 23, 2015 entitled The Puttskee.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates to a putting game device to test a user's putting skills. The putting game device provides a rigid putting surface with an attached green that leads to a ramp. The user putts the ball at the ramp to launch the ball into at least one target cup. A variety of games may be played with the cups. Games, such as scoring, cricket, cutthroat, dart type games, etc. may be played based on sinking the ball into specific targets.

The game device also enables the installation of different game boards for different target arrangements. The different boards arrange the targets in different locations to vary the game.

The putting game device also stores within a mobile housing. A handle of the housing enables the user to carry the housing and game to different locations. Wheels may also attach to the housing to simplify transporting the housing to different locations.

II. Known Art

Patents and patent applications disclosing information relevant to putting games are disclosed below. These patents and patent applications are hereby expressly incorporated by reference in their entirety.

U.S. Pat. No. 1,262,314 issued to Downey on Apr. 9, 1918 teaches a put-ball game apparatus.

U.S. Pat. No. 7,294,062 issued to Ting on Nov. 13, 2007 ("the '062 patent") teaches an indoor putting game device that includes a main body, a plurality of goal boards with different patterns and ball holes of different numbers optionally selected to be mounted on the main body, and a flexible ball course member wound on a shaft in the main body possible to be pulled out from a front end of the main body. The main body taught by the '062 patent has the shaft for winding the ball course member while not used or releasing it out for use. The goal board taught by the '062 patent can be adjusted in its inclination by optionally inserting position pins in a pair of pinholes in two sidewalls of the main body. So the device taught by the '062 patent can be used in playing putting game in various modes, boosting users' interest in playing and achieving game and exercise effect.

The known art does not provide a rigid putting surface. Instead, the known art provides either no putting surface or a flexible ball course member. The flexible ball course member taught by the '062 patent winds onto a shaft. The flexibility of the flexible ball course member required to wind onto the shaft taught by the '062 patent prevents the flexible course member from providing a rigid putting surface. The flexible ball course member does not lay flat and will somewhat form to the underlying surface on which the flexible course member is placed. Such a flexible course member fails to provide a smooth putting surface. Instead, bumps, ridges, and other obstacles will form on the flexible course member.

Therefore, the present invention is needed to provide a unique device for a putting skill game. The rigid putting surface of the present invention provides a consistent putting surface for playing the skill game.

SUMMARY OF THE INVENTION

The present invention relates to a putting game device to test a user's putting skills that can be played either indoors or outdoors. The putting game device provides a rigid putting surface with an attached green that leads to a ramp. The ramp and putting surface store within a housing to create a mobile game that is easily stored and transported.

The housing includes a support to angle the housing and the game board for play. Each game board provides at least one cup, preferably multiple cups, for the user to putt the ball into. The targets may be simple holes in the game board or the targets may be a raised target that extends vertically above the game board.

The user putts the ball at the ramp to launch the ball into at least one target cup. In one embodiment, each target cup is assigned a particular value for scoring the game. A variety of games may be played with the cups. Games, such as a scored game, cricket, cutthroat, dart type games, etc. may be played based on sinking the ball into specific targets.

The ball enters either a target aperture or exit aperture after the user putts the ball. The housing includes at least one ramp that leads to a ball return that returns the ball to the user. The ball return slopes downward to return the ball to the user. The ball return releases the ball onto the putting surface on which the ball rolls to the user.

The game device also enables the installation of different game boards for different target arrangements. The different boards arrange the targets in different locations to vary the game. Such variation of the targets varies the game play and requires the user to sink different putts to increase the difficulty and the replay value of the game.

The putting game device also stores within a mobile housing. A handle of the housing enables the user to carry the housing and game to different locations. Wheels may also attach to the housing to simplify transporting the housing to different locations.

It is an object of the present invention to provide a putting skill game that challenges a player.

It is another object of the present invention to provide storage for the ramp, game board, and putting extension within the housing to increase the portability of the game.

It is another object of the present invention to provide a portable putting game.

It is another object of the present invention to provide an interchangeable game board to increase the replay value of the game.

It is another object of the present invention to provide different targets and scoring zones.

It is another object of the present invention to provide a rigid, smooth putting surface for putting the ball onto the game board.

It is another object of the present invention to provide one or more putting extensions attachable to the ramp to increase the length of the putting surface leading to the ramp.

It is another object of the present invention to provide a scoring screen showing the score of the players.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 7 is a perspective view thereof;

FIG. 8 is a perspective view thereof;

DETAILED DESCRIPTION

Figure 1:
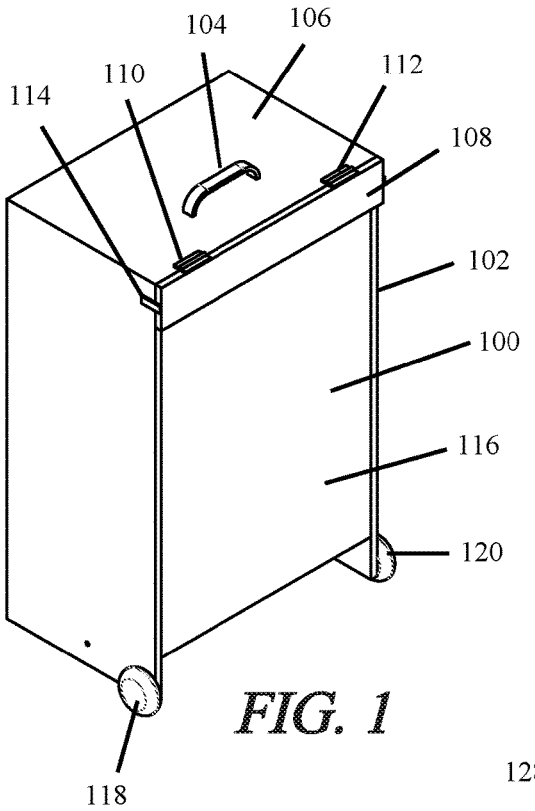
FIG. 1 is a front perspective view of one embodiment of the present invention.

FIG. 1 shows the putting game 100 generally in the closed position. The putting game 100 is stored within a mobile, compact housing 100 that is easily transported via handle 104 and wheels 118, 120. The handle 104 is positioned on top 106 to allow the housing to be rolled similar to rolling luggage via wheels 118, 120.

The housing 102 stores a number of the components for playing the game. Front wall 116 pivotally attaches to the housing 102 to open the housing. Locking finger 108 attaches to top 106 via hinges 110, 112. Lock 114, such as a catch, locks the locking finger 108 in the closed position. The locking finger 108 in the closed position secures the front wall 116 shut. The user can then easily transport or store the housing 102.

Figure 2:
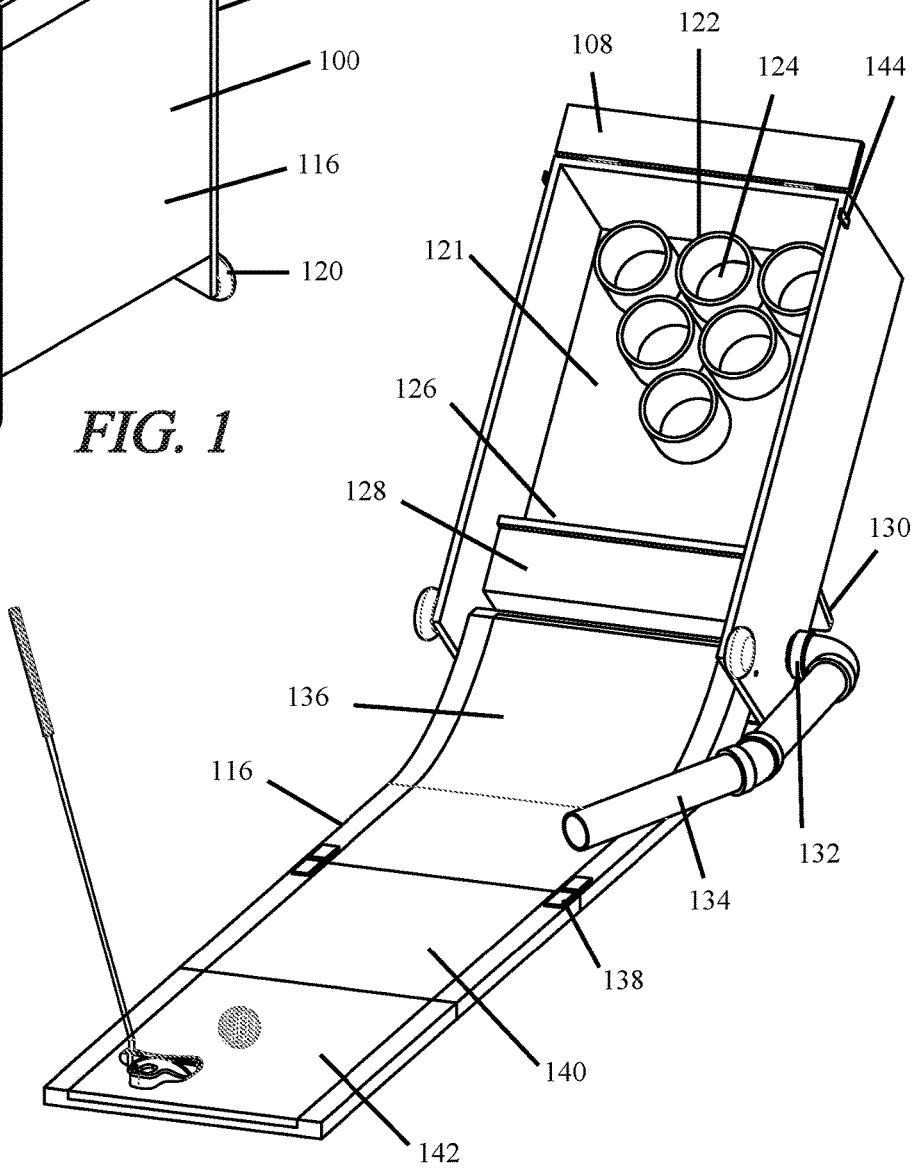
FIG. 2 is a front perspective view thereof.

FIG. 2 shows the housing 102 in the open position. The user has disengaged latches 114, 144 to open locking finger 108. The user can then pivot front wall 116 outwards to the open position. The front wall provides ramp 136 that launches the ball towards target apertures 124 and cups 122. The user putts the ball at ramp 136 that provides an incline for launching the ball over the blocking wall 128 at target apertures 124.

Putting surface 140 attaches to ramp 136 by hinges 138. Hinges 138 are located on a side surface of the ramp 136 and putting surface 140 to avoid interfering with the putts. Hinges 138 are located exterior to the putting green. The putting surface 140 folds outward from front wall 116 to increase the distance the user must putt the ball. Putting extension 142 increases the distance of the putt even further. The user may add as many or as few putting extensions 142 as needed to set the appropriate distance for putting the ball.

Putting extension 142, putting surface 140, and ramp 136 provide a rigid surface from which to putt. Putting extension 142, putting surface 140, and ramp 136 may be constructed from wood, plastic, metal, or other rigid material. The rigid surface of the putting extension 142, putting surface 140, and ramp 136 does not conform to the underlying ground. The rigid putting surface avoids bumps, wrinkles, creases, and other obstacles that the user must contend with to putt.

The user putts the ball from putting extension 142 towards ramp 136. Ramp 136 launches the ball upwards toward the targets. Each target is assigned a particular score. For example, each target could be assigned a value of 1 through 6. The user aims for the different targets based upon the game being played.

For example, if the user is playing for the highest score, the user aims for the target assigned the largest value. The user aims for the target assigned the lowest value if the user is playing for the lowest score. In other games, the user may aim for a target other than the target that was previously hit in the game. The user could also play a golf game in which each target is assigned a score: 1, 2, 3, 4, 5, 6, 7, etc. depending on the number of cups. The user must then sink 18 putts to represent playing 18 holes of golf or 9 putts to represent playing 9 holes. The user adds a stroke if the user does not sink the ball into any of the putts. The user adds a penalty stroke for the hole if the user hits the ball out of bounds (off of the board) or if the ball does not reach the game board.

For example, a game board may include seven (7) targets with each target assigned a value of 1 to 7. The user on his first shot sinks the ball into the 1 cup. The user scores a hole in one for the first hole.

On the second hole, the user hits the first putt on the game board but the ball does not enter a target. The user then sinks the second putt into the 3 cup. The user is assigned a score of four for the second hole.

On the third hole, the user putts the first putt off of the game board for a penalty stroke. The user then putts the second putt into the two hole. The user scores four (4) for the third hole due to the penalty stroke.

After entering one of the target apertures 124, the ball returns to the user through ball return 134. However, the user may not always sink the putting into one of the target apertures 124. The game board provides a board exit 126 for the ball that does not enter the target aperture 124.

The game board 121 slants towards the board exit 126 to direct the ball towards the board exit 126. The ball rolls through the exit connector 132 and ball return 134 and the ball is returned to the user on the putting surface or putting extension.

The ball return 134 may be implemented as a tube, pipe, ramp, slide, or other inclined surface. The ball return 134 of one embodiment is constructed from PVC pipe and other fittings to dispense the ball on the putting surface.

In another embodiment, the ball return is constructed as a wooden ramp that returns the ball on the putting surface. The ball return implemented as a wooden ramp may be placed adjacent the exit 174 without the use of the exit connector. The ramp sits below exit 174 to receive the ball. The ramp may have a raised wall located opposite the side of the ramp adjacent the putting surface. The raised wall prevents the ball from rolling off the ramp away from the putting surface. The end of the ramp angles inwards towards the putting surface to direct the ball onto the putting surface. The end of the ramp angling inwards avoids placement of the ramp on the putting surface.

Figure 3:
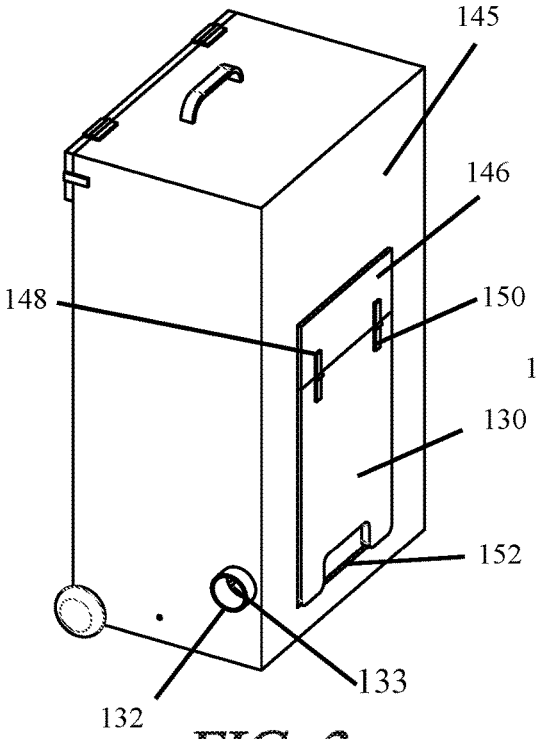
FIG. 3 is a rear perspective view thereof.

FIG. 3 shows the back wall 145 and the support leg 130 attached to the housing. Support leg 130 pivotally attaches to the back wall 145 to support the housing 102 at an angle as shown in FIG. 2. In one embodiment, a chain or other restrictor is secured to the back wall 145 and the support leg 130. The chain or other restrictor prevents the support leg from creating too great of an angle to support the housing. In one embodiment, the chain or other restrictor sets the angle at which the support leg 130 pivots away from the back wall 145 of the housing. The user simply pivots the support leg 130 away from back wall 145 until the chain or other restrictor prevents the support leg 130 from pivoting any further.

Support body 146 attaches to rear wall 145 to provide additional support to support leg 130. Hinges 148, 150 secure the support leg 130 to the rear wall 145 for pivoting of the support leg 130. Support leg 130 is located opposite of wheels 118, 120 to keep the support leg 130 against rear wall 145 during transporting the housing 102. Handle 152 provides a grip for the user to position the support leg 130 for positioning the housing during use.

Figure 6:
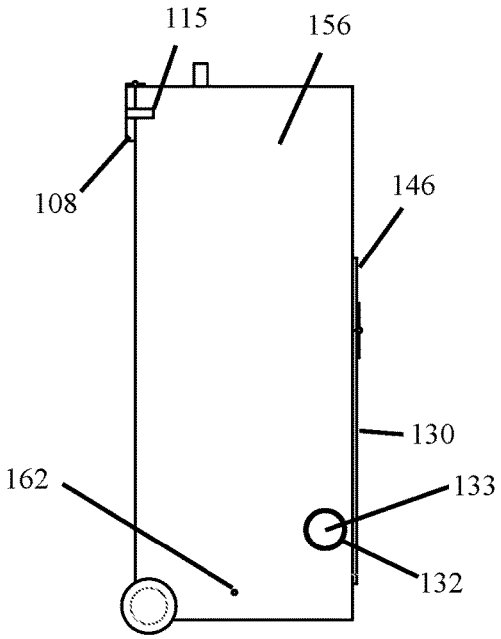
FIG. 6 is a right side view thereof.

FIGS. 3 and 6 also show exit connector 132. Exit connector 132 provides a surface area for securing ball return 134 as shown in FIG. 2. The exit connector 132 provides exit 133 for the ball to exit from the housing. The game includes ball guides that lead the ball from the target apertures 124 and board exit 126 to the exit connector 132.

Figure 4:
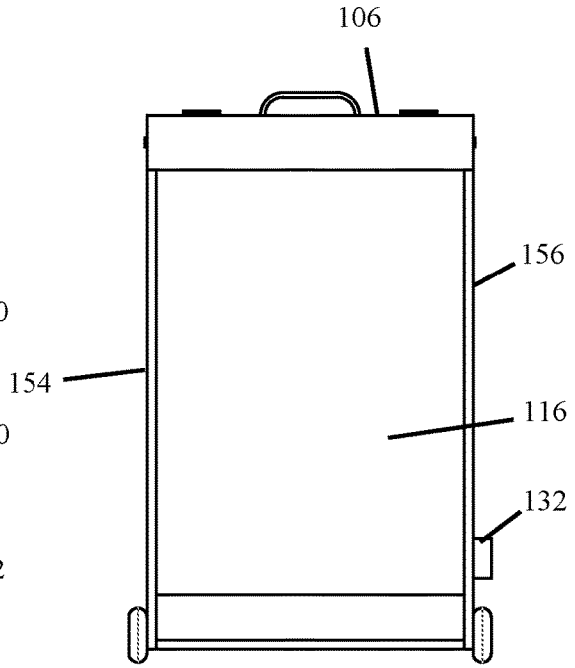
FIG. 4 is a front view thereof.

FIG. 4 shows the top 106, side walls 154, 156 and front wall 116. Exit connector 132 extends from one of the side walls 156. The exit connector 132 could be located on either side wall to return the ball to the user.

Figure 5:
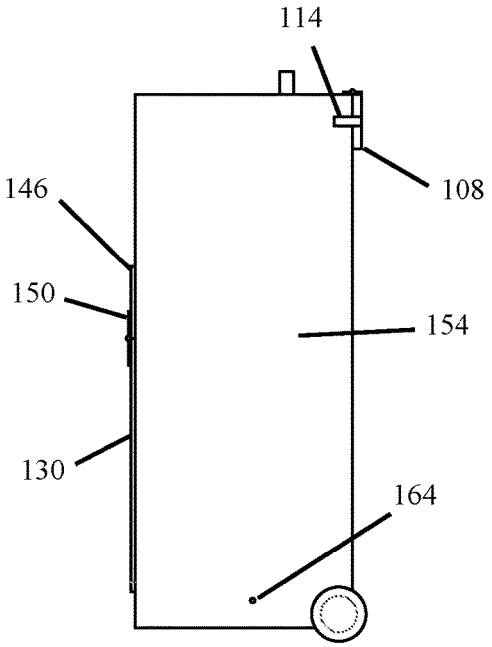
FIG. 5 is a left side view thereof.

FIGS. 5 and 6 show the side walls 154, 156. Locks 114, 115, such as catches, secure the locking finger in the closed position to secure the front wall 116 in the locked position. Support body 146, support leg 130 and hinges 148, 150 secure to the rear wall opposite of the wheels. Such attachment of the support leg 130 to the rear away from the handle and wheels positions the support leg 130 toward the housing so that the support leg 130 does not pivot outwards to contact the ground and impede transporting the housing.

Pivots 162, 164 secure the front wall 116 to the housing 102. The front wall pivots outwards away from the housing to position the ramp and putting surface. When finished playing, the user pivots the front wall towards the housing for storing the ramp within the housing.

FIGS. 7 and 8 show opening the housing for playing the game. Locking finger 108 is unlatched from the housing to position the locking finger 108 to the open position. The user then pivots front wall 116 out of housing front wall 116 secures to the putting surface 140 via hinge 138. Putting surface 140 is pivoted upwards to fold putting surface 140 above ramp 136 for storage. Putting extension 142 also fits within housing 102.

Figure 11:
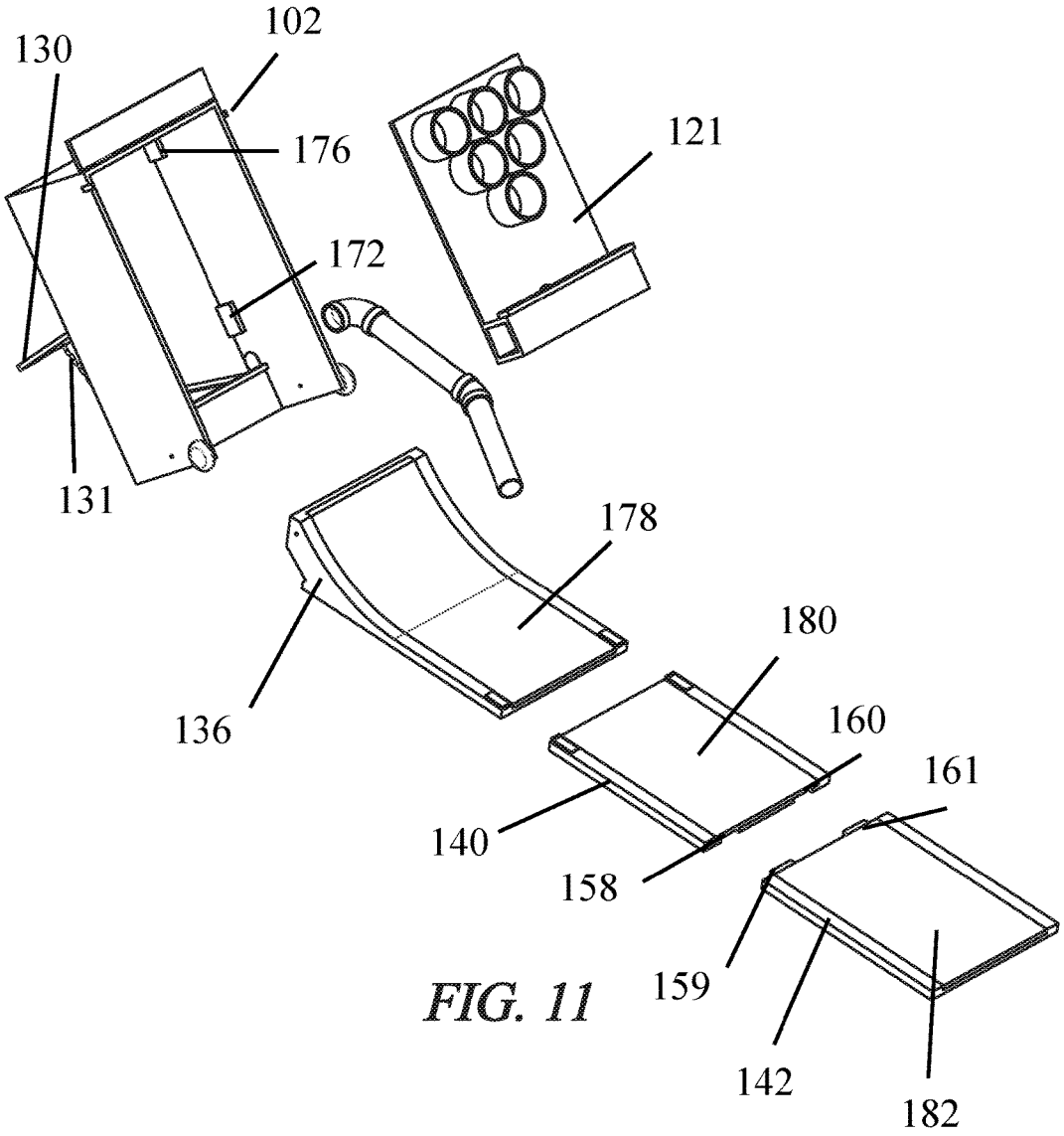
FIG. 11 is an exploded view thereof.
Figure 12:
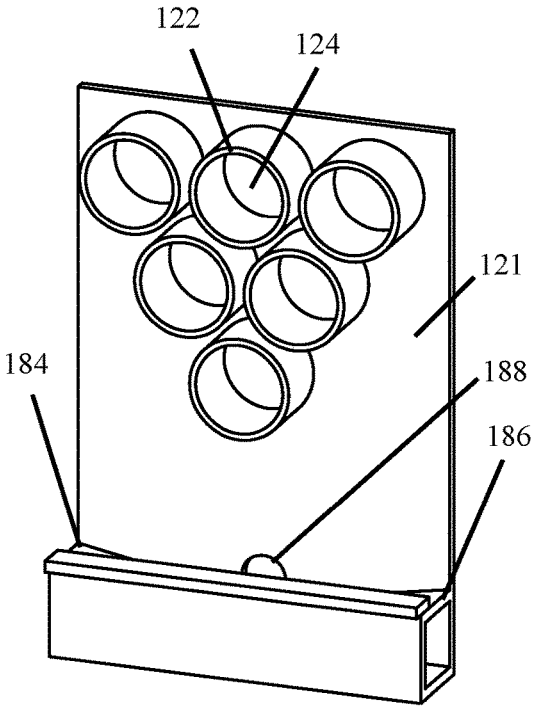
FIG. 12 is a front perspective view of a game board of one embodiment of the present invention.
Figure 13:
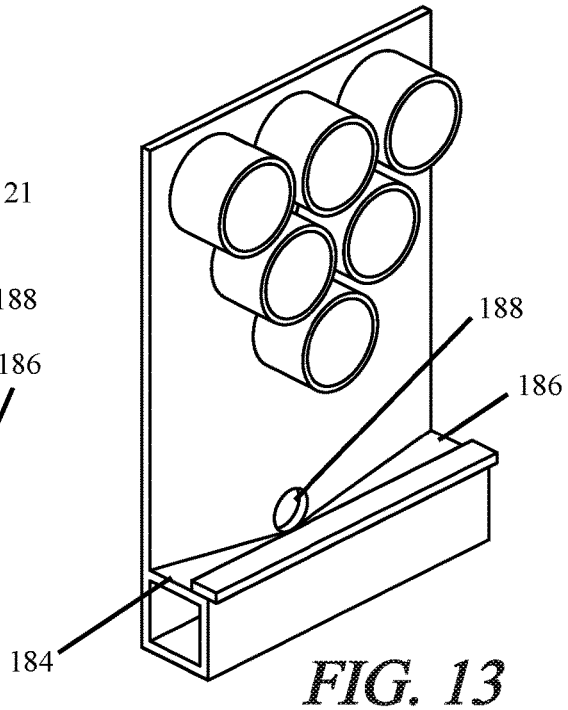
FIG. 13 is a front perspective view thereof.
Figure 14:
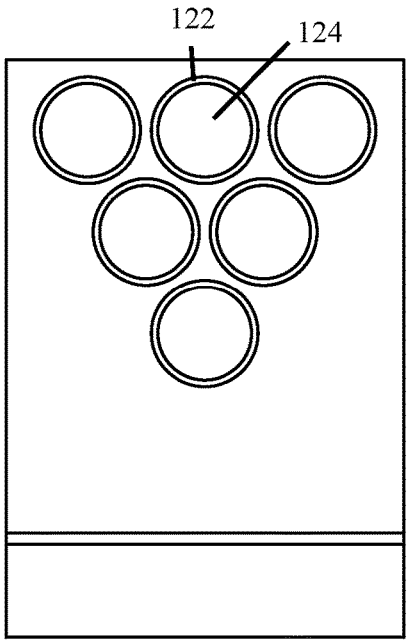
FIG. 14 is a front view thereof.
Figure 15:
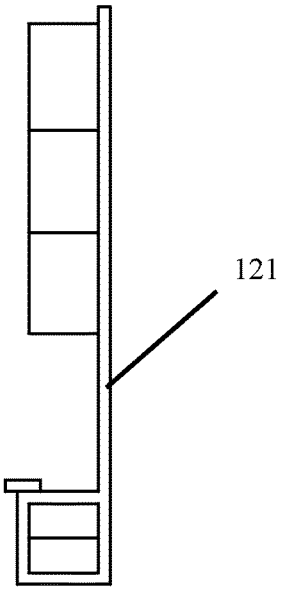
FIG. 15 is a right side view thereof, the left side view being a mirror image of the left side view.
Figure 16:
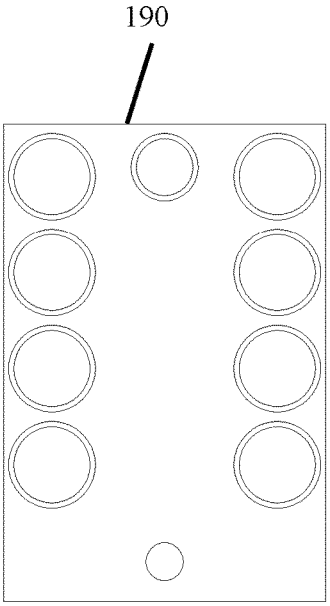
FIG. 16 is a front view of a game board of one embodiment of the present invention.

Front wall 116 pivots outward at pivot 162 away from housing 102. Putting surface 140 is also pivoted outward from housing 102. Putting surface 140 provides attachment apertures 158, 160 for securing extension 142. Two attachment fingers 159, 161 as shown in FIG. 11 protrude from putting extension 142 to secure within attachment apertures 158, 160. The green covers the attachment apertures 158, 160 and the attachment fingers to provide a rigid putting surface.

Putting extension 142 of one embodiment may also provide a similar set of attachment apertures as the putting surface 140. The attachment apertures of putting extension 142 enable attachment of additional putting extensions to a putting extension via attachment apertures and attachment fingers of the putting extensions.

Figure 9:
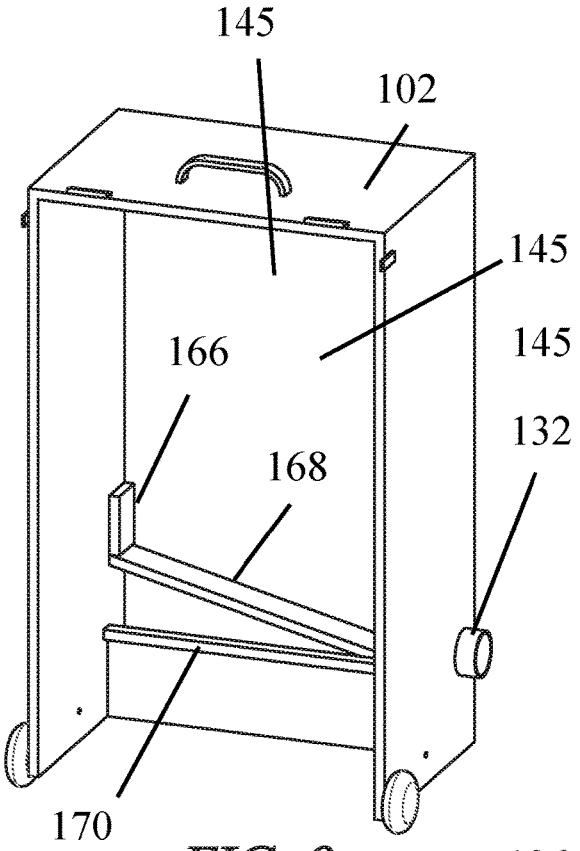
FIG. 9 is a partial view thereof.
Figure 10:
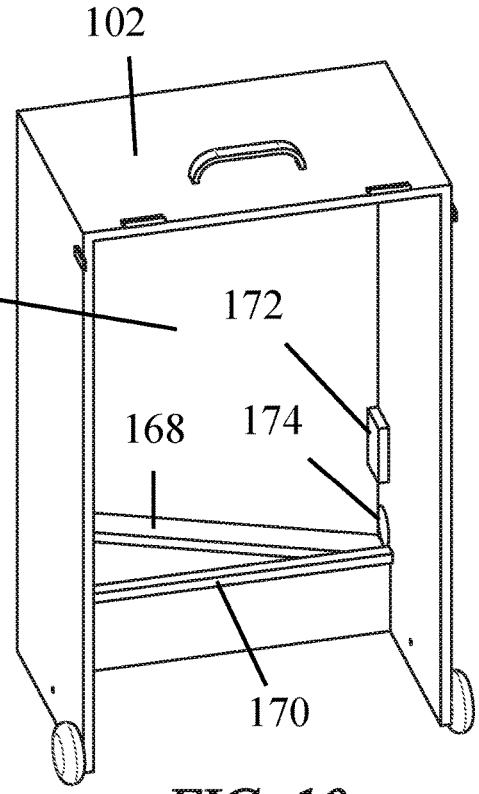
FIG. 10 is a partial view thereof.
Figure 10A:
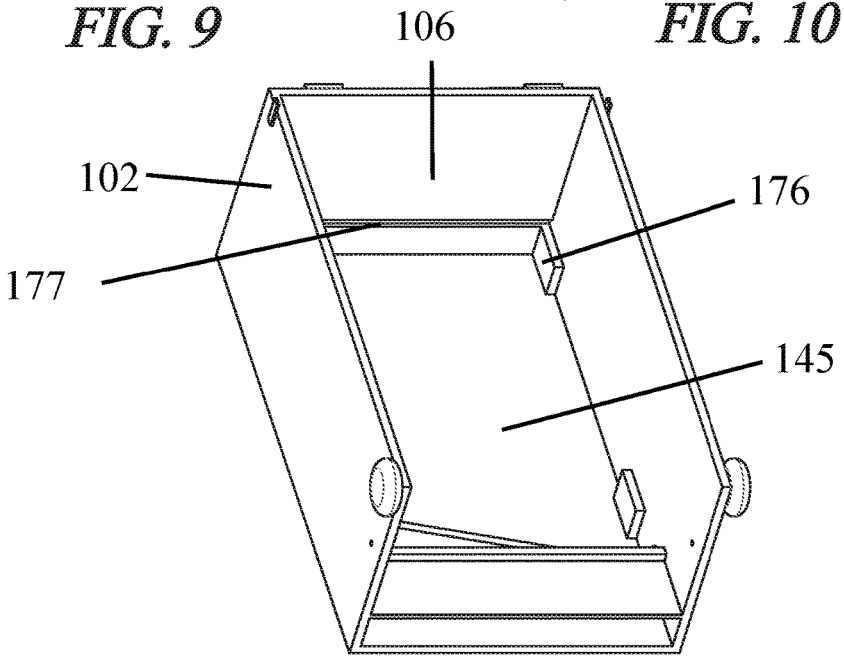
FIG. 10A is a partial view thereof.

FIGS. 9, 10, and 10A show the housing 102 with the game board 121 removed. The interior of housing 102 provides an exit ramp 168 that guides the ball out of the housing. Exit ramp 168 secured between the side walls directs the ball towards exit 174. Exit 174 leads the ball to exit connector 132 and ball return 134. The exit ramp 168 of one embodiment is located vertically below all target apertures 124 and the board exit 126. When the ball enters either a target aperture 124 or board exit 126, the angle of the housing during play directs the ball towards exit ramp 168. Exit ramp 168 then guides the ball to the exit 174.

FIGS. 9, 10, 10*a* show the board supports 166, 170, 172, 176 that support the game board. The game board 121 is placed upon supports 166, 170, 172, 176. Supports 166, 170, 172, 176 position the game board 121 for play. In one embodiment, the housing provides a top groove 177 for placement of the upper section of the game board 121 into the groove 177.

FIG. 11 shows an exploded view of the device. Support leg positioner 131, such as a chain, rope, a webbing, or other restrictor, secured to the housing 102 and the support leg 130 positions the support leg 130 for usage. Game board 121 rests upon supports 172, 176. Ramp 136 pivotally attaches to the housing 102. Putting surface 140 attaches to the ramp 136. Putting surface 140 of one embodiment pivotally attaches to the ramp 136 to increase the distance putted to reach the incline of the ramp 136. In another embodiment, putting surface 140 may attach to the ramp via attachment fingers similar to the attachment of putting surface 140 to putting extension 142. Attachment fingers 159, 161 of putting extension 142 secure within attachment apertures 158, 160 of putting surface 140.

Each of the ramp 136, putting surface 140, and putting extension 142 provide a putting green 178, 180, 182. The putting greens provide an artificial putting green that is attached to the solid rigid surfaces of the ramp 136, putting surface 140, and putting extension 142. The putting green provides for a more natural roll of the ball similar to the roll that a putter would experience on an actual green.

FIGS. 12-15 show game board 121 with target cups 122 and target apertures 124. The target cups 122 are raised above the game board. 121. The user aims for the target cups 122 to putt the ball into target apertures 124. In one embodiment, the user aims for one of seven targets. If the user does not hit the ball into one of the targets, the game board provides a board exit, such as board exit 188.

The housing 102 positions the game board 121 at an angle that directs the balls downwards toward exit 188 if the ball does not enter a target aperture 124. Board exit ramps 184, 186 are raised above the game board 121 similar to target cups 122. The board exit ramps 184, 186 angle inwards towards exit 188. The ball entering either target apertures 124 or exit 188 places the ball above ramp 168. Ramp 168 directs the ball towards the exit of the housing 102.

Figure 17:
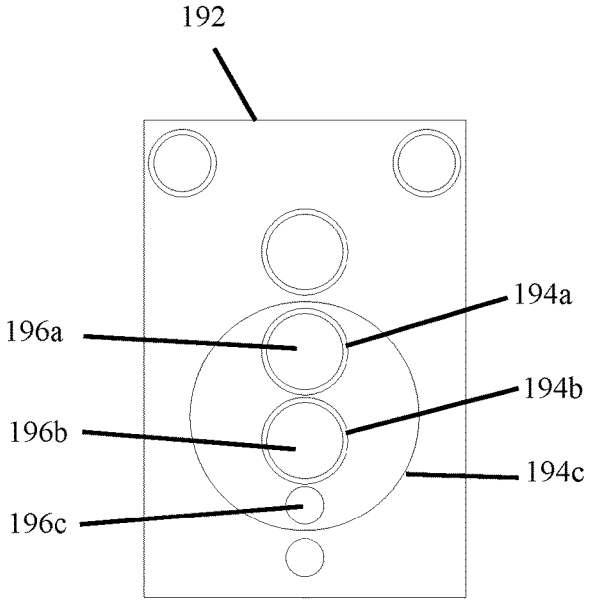
FIG. 17 is a front view of a game board of one embodiment of the present invention.

FIGS. 16-19 show different embodiments of game boards 190, 192, 194, 196. The different game boards provide different variations of targets and target apertures. The target cups may vary in size as shown in FIGS. 16-19. FIG. 17 shows multiple target apertures 196*a*, 196*b*, 196*c* within target 194*c*. Targets 194*a*, 194*b* are located within target 194*c*.

Figure 18:
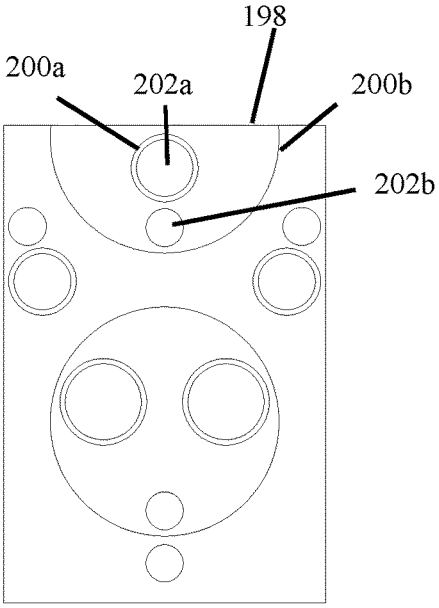
FIG. 18 is a front view of a game board of one embodiment of the present invention.
Figure 19:
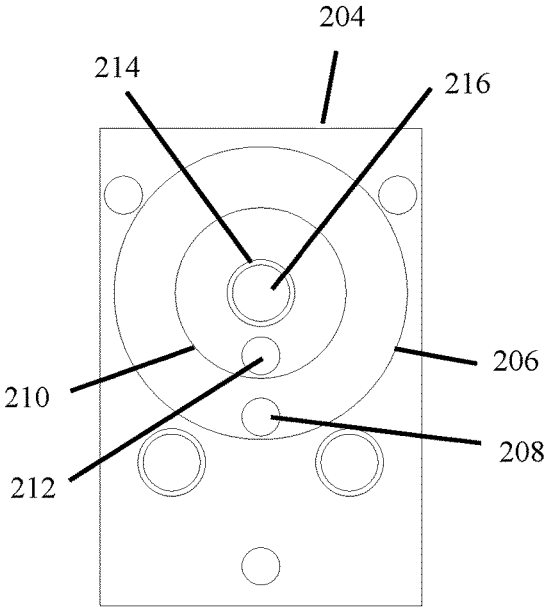
FIG. 19 is a front view of a game board of one embodiment of the present invention.

FIG. 18 shows multiple target apertures 202*a*, 202*b* within target 200*b*. Target 202*a* encompasses target aperture 200*a*. FIG. 19 shows an arrangement of target apertures 208, 212, 216 within target 206. Targets 210, 214 are also located within target 206.

Figure 20:
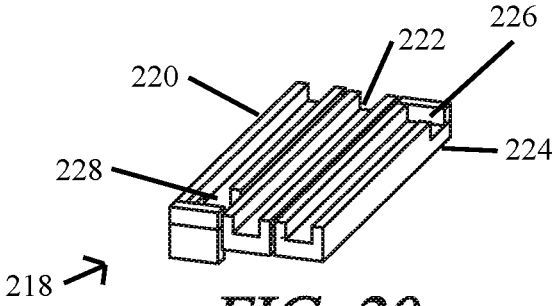
FIG. 20 is a perspective view of a ramp of one embodiment of the present invention.
Figure 21:
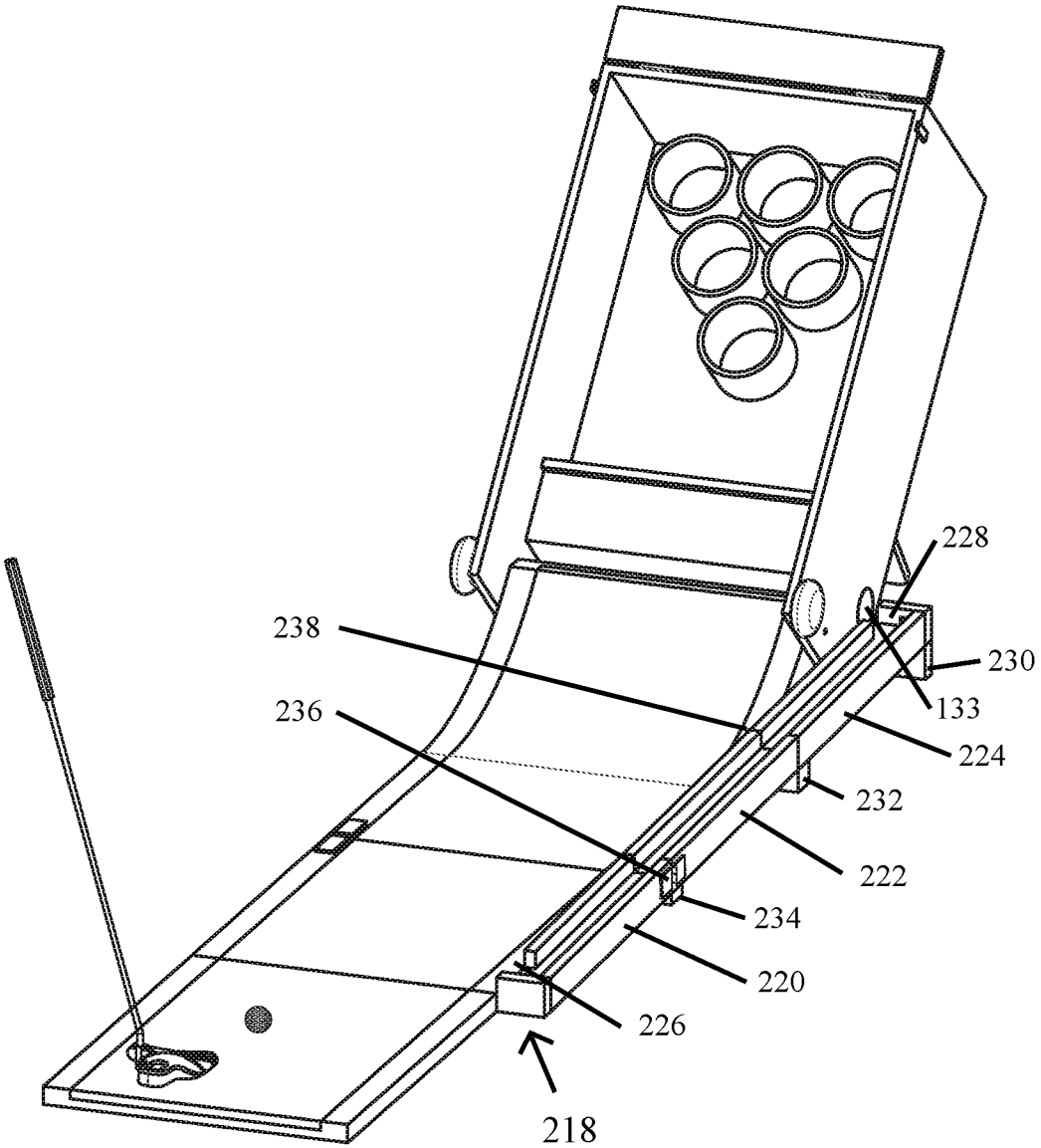
FIG. 21 is a perspective view of one embodiment of the present invention.
Figure 22:
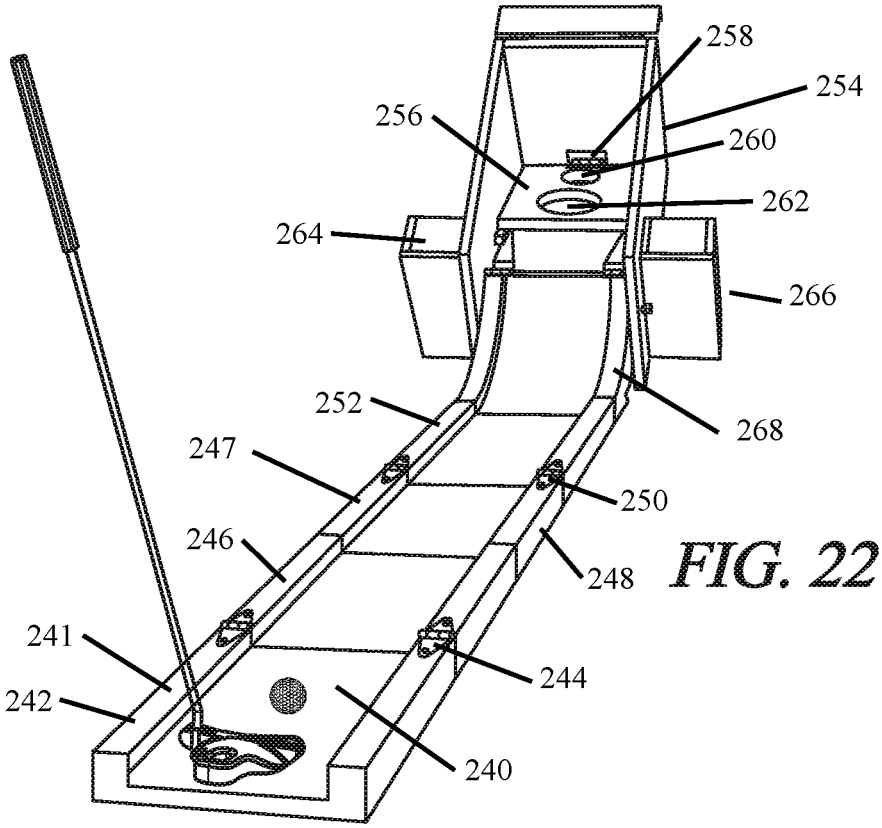
FIG. 22 is a perspective view of one embodiment of the present invention.

FIGS. 20 and 21 show a ball return 218 constructed from a number of return segments 220, 222, 224. The segments 220, 222, 224 provide an inner wall and outer wall that define a return pathway directing the ball from entrance 228 to exit 226. Entrance 228 is located vertically above exit 226 to form a ramp to direct the ball to exit 226. Supports 230, 232, 234 create the incline of the ball return 218 to direct ball to exit 226.

The segments 220, 222, 224 are hinged together to allow the segments 220, 222, 224 to pivot towards each other to compact down. Hinges 236, 238 located on opposite sides of ball return 218 enable ball return 218 to compact down to the storage position as shown in FIG. 20. The ball return 218 also opens up to the use position as shown in FIG. 21.

Entrance 228 of the ball return 218 is positioned adjacent the exit 133 of the housing. The ball exits the housing at exit 133 to enter the ball return 218 at entrance 228. The ball rolls down ball return 218 towards exit 226. The walls of ball return 218 maintain the ball on the ball return 218 until the ball reaches exit 226. The ball return 218 provides an exit wall that guides the ball through exit 226 onto the putting surface.

FIGS. 22-25 show one embodiment of the putting skill game. The user putts the ball from putting surface 240 towards game board 256 within housing 254. Putting section 241 attaches to putting section 247 to form putting surface 240. Putting sections 241, 247 secure to each other through such connectors as tongue and groove and attachment fingers and apertures shown in FIG. 11.

Figure 26:
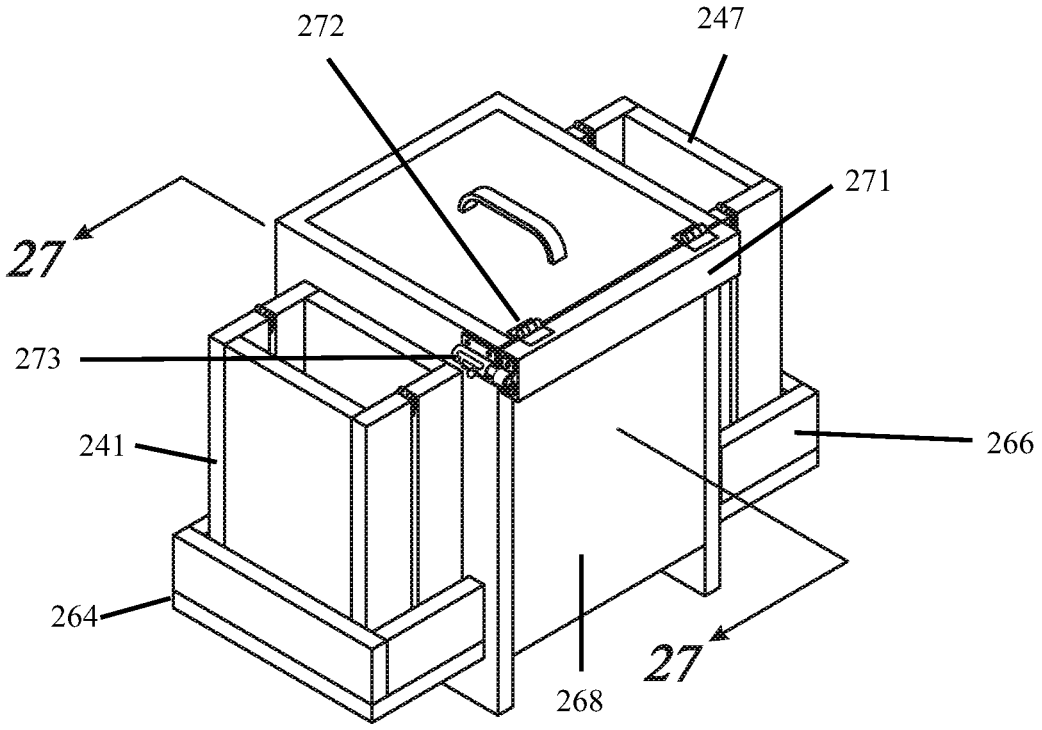
FIG. 26 is a perspective view thereof.

Putting section 241 is constructed from putting segments 242, 246 which are pivotally attached to each other at hinges 244. Putting section 247 is constructed from putting segments 248, 252 which are pivotally attached to each other at hinges 250. The hinges 244, 250 allow putting sections 241, 247 to pivot towards each other to a storage position as shown in FIG. 26. The putting sections are then inserted into storage 264, 266 for storage and transportation.

The user putts the ball from putting surface 240 towards ramp 268. The ramp 268 launches the ball towards game board 256. Game board 256 provides two apertures 260, 262 for the ball to enter for scoring. Otherwise, the ball simply rolls off the game board 256 towards putting surface 240.

Figure 23:
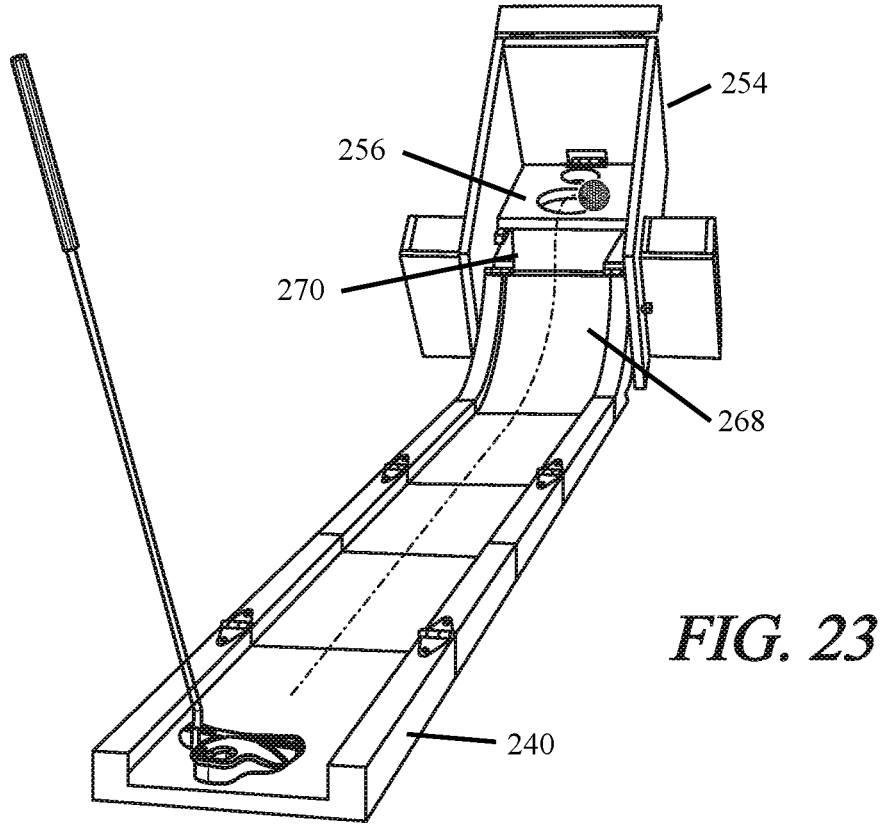
FIG. 23 is a perspective view thereof.

FIG. 23 shows the ball on game board 256. The user putts the ball from putting surface 240 towards ramp 268. The ramp 268 launches the ball onto game board 256. The walls of the housing 254 direct the ball towards the game board 256. The walls of the housing 254 limit the number of lost balls due to putting the ball with too much force. The ball drops through one of the target apertures onto ball return 270 that returns the ball to the user.

Figure 24:
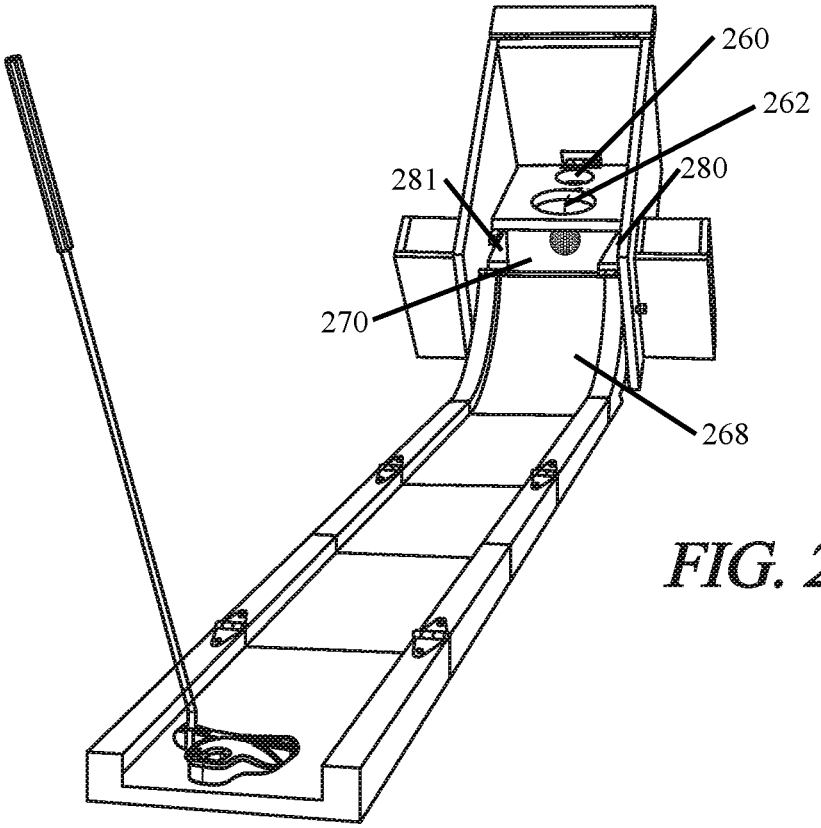
FIG. 24 is a perspective view thereof.
Figure 25:
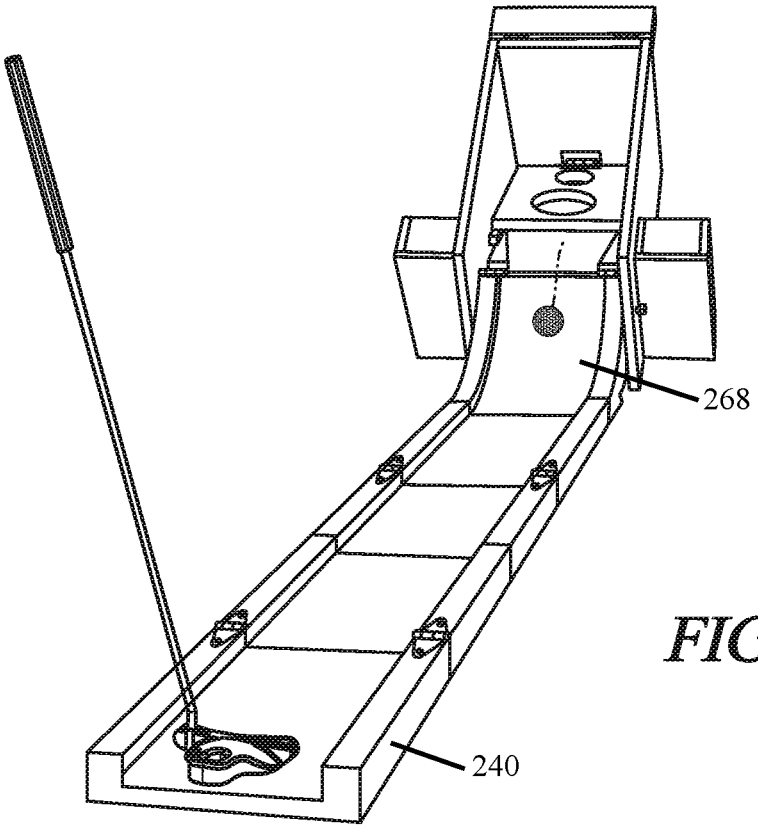
FIG. 25 is a perspective view thereof.

FIGS. 24 and 25 show the ball returning to the user. The ball enters either target aperture 260, 262. The ball travels to ball return 270. Ball guides 280, 281 secured to the ball return 270 direct the ball towards the center of ramp 268 and putting surface 240. The ball guides 280, 281 form a wedge to prevent the ball from rolling off the side of the ramp 268 or the putting surface 240.

FIG. 26 shows the putting game in the storage/transport mode. Storage 264, 266 extends to the sides of the housing. The storage 264, 266 provides sufficient space for placement of the putting sections 241, 247 within storage 264, 266. The putting sections 241, 247 fold into transport mode for placement into the storage 264, 266. The putting sections 241, 247 in transport mode are then inserted into storage 264, 266.

Ramp 268 pivots into the housing. Locking finger 271 adjusts downward to contact ramp 268. Locking finger 271 attaches to the housing at hinge 272. The locking finger 271 secures the ramp 268 in the closed position to maintain the closed position. A lock 273, such as barrel bolt, located on the housing secures the locking finger 271 in the locked position. The barrel bolt when locked restricts movement of the locking finger 271 to maintain the ramp 268 in the closed position. The user unlocks the barrel bolt to release the locking finger 271 to adjust the ramp 268 to the play position for game play. The lock 273 may be located on either side of the housing to secure the locking finger 271.

Figure 27:
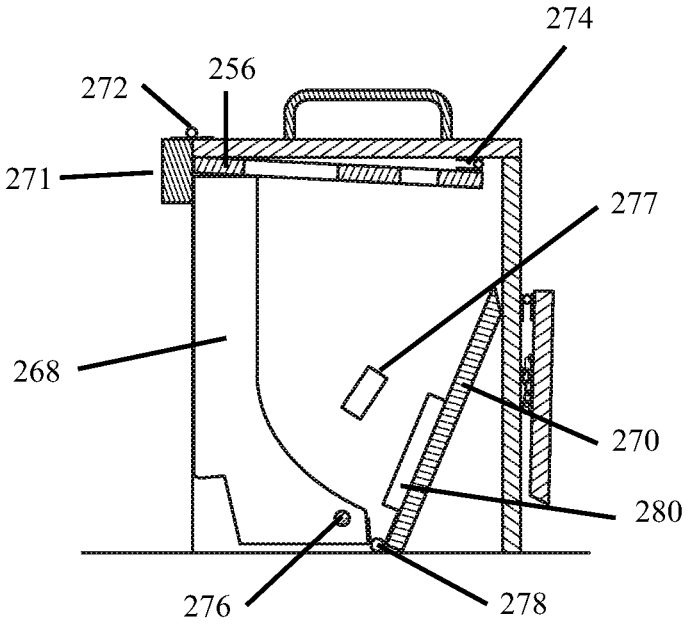
FIG. 27 is a sectional view thereof.

FIG. 27 shows the ramp 268 pivotally attached to the housing at pivot 276. Pivot 276 enables ramp 268 to adjust into and out of the housing. The ramp 268 pivots into the housing for storage and transportation as shown in FIG. 27. The ramp 268 pivots out of housing for game play as shown in FIG. 28.

Game board 256 adjusts upwards towards the top of housing as shown in FIG. 27. Hinge 274 secures the game board 256 to the top of the housing. The game board adjusts upward prior to insertion of ramp 268 into housing. Ramp 268 supports the game board in the upward position for storage.

Ball return 270 pivotally attaches to ramp 276 at hinge 278. Adjustment of ramp 276 alters the positioning of ball return 270 and ball guides 280, 281. Board stop 276 positions the game board 256 for playing the game as shown in FIG. 28.

Figure 28:
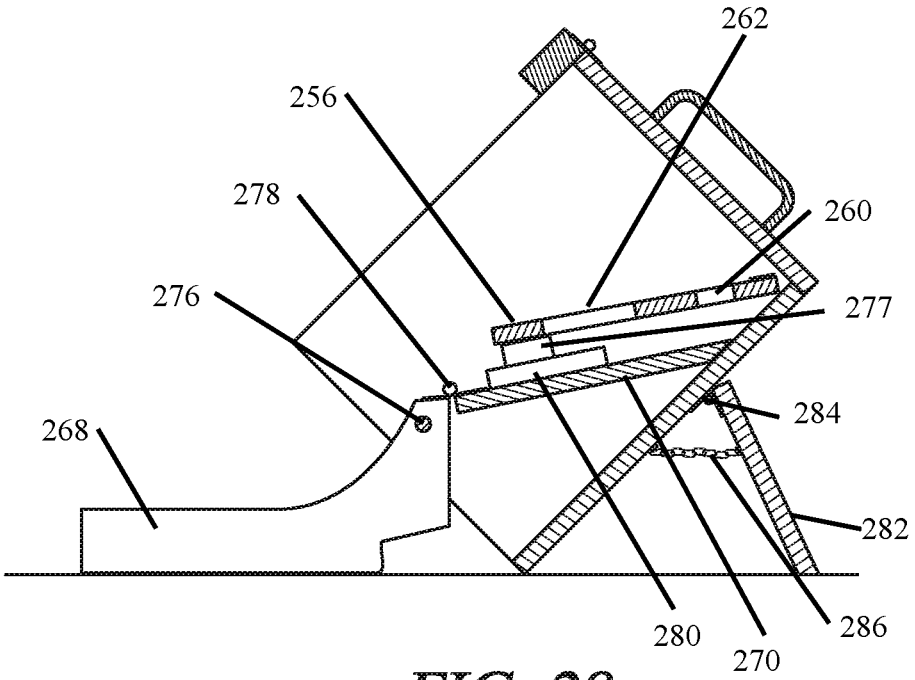
FIG. 28 is a sectional view thereof.
Figure 29:
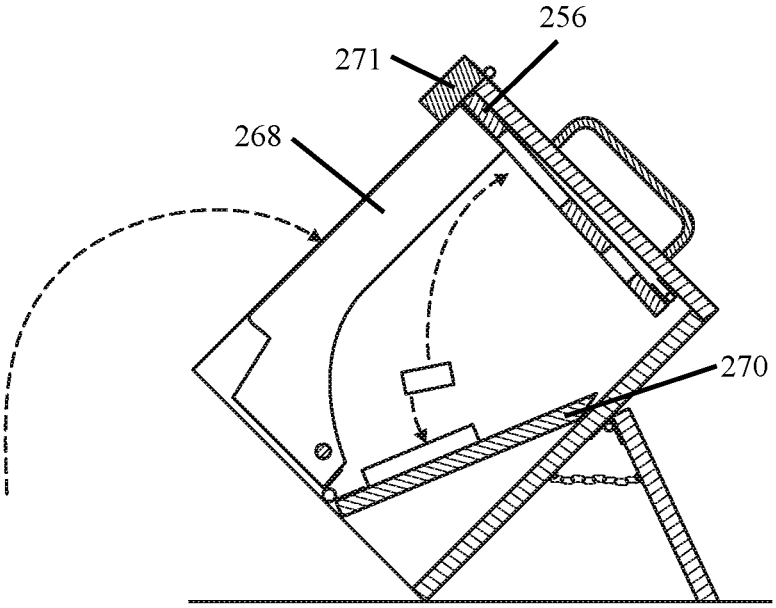
FIG. 29 is a sectional view thereof.

FIG. 28 shows the putting game in the play position. The user positions support leg 282 away from housing. Hinge 284 enables the adjustment of support leg 282. Support leg tensioner 286 establishes the angle at which the housing is positioned for game play. The support leg tensioner 286 maintains a consistent angle for the housing to provide for consistent game play.

Ramp 268 pivots outward from housing at pivot 276. The pivotal attachment of ball return 270 to ramp 268 at hinge 280 raises ball return 270 as ramp 268 is pivoted downward for use. Pivoting of ramp 268 into the use position adjusts the ball return 270 and ball guides 280, 281 into the use position.

Pivoting ramp 268 into the use position also removes the support applied to game board 256. Game board 256 drops into the use position without the support of ramp 268. Board stop 277 supports the game board 256 in the use position. The game board 256 and target apertures 260, 262 are positioned for play. The board stop 277 positions the game board 256 to provide the appropriate roll of the ball and to provide consistent game play.

In one embodiment, the target cups are constructed from plastic pipe, such as PVC pipe, that is cut to the desired height. One embodiment of the game requires users to sink the ball within all of the cups to win. The user caps off the target cups which the user has previously sunk the ball. The user may attach blocking lids on the target cups to close the hole. The lid may be a cap or other lid that would prevent the ball from entering the target aperture below the cap or lid.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A putting skill game device for putting a ball up an incline to sink the ball into a target, the device comprising:

a game board with at least one target aperture providing passage of the ball through the game board;

a housing for placement of the board;

a ramp secured to the housing wherein the ramp provides the incline to launch the ball at the game board;

a putting surface providing a rigid surface leading to the ramp;

wherein the ramp pivotally attaches to the housing wherein the ramp pivots into and out of the housing;

wherein the putting surface pivotally attaches to the ramp wherein the putting surface folds onto the ramp;

a locking finger adjustably attached to the housing wherein the locking finger adjusts toward the ramp to contact the ramp, the locking finger secures to the housing in a locked position that contacts the ramp to secure the ramp within the housing.

2. A putting skill game device for putting a ball up an incline to sink the ball into a target, the device comprising:

a game board with at least one target aperture providing passage of the ball through the game board;

a housing for placement of the game board wherein the ball passes through the target aperture into the housing;

a ramp pivotally attached to the housing wherein the ramp provides the incline to launch the ball at the game board, the ramp pivoting into the housing for storage and out of the housing for usage;

a putting surface providing a rigid surface leading to the ramp;

a first side wall of the housing;

a second side wall of the housing;

and a rear wall of the housing;

wherein the ramp serves as a front wall of the housing, the ramp pivotally attached to the first side wall and the second side wall of the housing;

wherein the putting surface pivotally attaches to the ramp wherein the putting surface folds onto the ramp;

a locking finger adjustably attached to the housing wherein the locking finger adjusts toward the ramp to contact the ramp, the locking finger secures to the housing in a locked position that contacts the ramp to secure the ramp and the putting surface within the housing.

3. The device of claim 2 wherein the locking finger is located vertically above the pivotal attachment of the ramp with the housing.

4. A putting skill game device for putting a ball up an incline to sink the ball into a target, the device comprising:

a game board with at least one target aperture providing passage of the ball through the game board;

a housing for placement of the game board, the housing having a first side wall, a second side wall, and a rear wall;

a ramp pivotally attached to the first side wall and the second side wall of the housing wherein the ramp provides the incline to launch the ball at the game board, the ramp pivoting towards the rear wall for storage and away from the rear wall for game play;

a putting surface providing a rigid surface leading to the ramp wherein the putting surface pivotally attaches to the ramp wherein the putting surface folds onto the ramp; and a locking finger adjustably attached to the housing wherein the locking finger adjusts toward the ramp to contact the ramp, the locking finger secures to the housing in a locked position that contacts the ramp to secure the ramp within the housing wherein the locking finger is located vertically above the pivotal attachment of the ramp with the housing.

* * * * *